US010996609B2

(12) United States Patent
Kunimasa et al.

(10) Patent No.: US 10,996,609 B2
(45) Date of Patent: May 4, 2021

(54) IMAGE FORMING APPARATUS PROVIDED WITH A FIXING BELT AND SHEET WIDTH POSITION ADJUSTMENT MECHANISM

(71) Applicant: KYOCERA Document Solutions Inc., Osaka (JP)

(72) Inventors: Takuto Kunimasa, Osaka (JP); Masanori Kyogoku, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/709,485

(22) Filed: Dec. 10, 2019

(65) Prior Publication Data

US 2020/0192257 A1 Jun. 18, 2020

(30) Foreign Application Priority Data

Dec. 13, 2018 (JP) ..... JP2018-233129

(51) Int. Cl.
*G03G 15/20* (2006.01)
*G03G 15/00* (2006.01)
*G03G 21/02* (2006.01)

(52) U.S. Cl.
CPC ..... *G03G 15/6558* (2013.01); *G03G 15/2039* (2013.01); *G03G 15/2053* (2013.01); *G03G 21/02* (2013.01); *G03G 2215/2016* (2013.01)

(58) Field of Classification Search
CPC ..... G03G 15/6529; G03G 15/6558; G03G 2215/00409; G03G 2215/00556; G03G 15/2053; G03G 21/02; G03G 2215/2016
USPC ..... 399/43, 388
See application file for complete search history.

(56) References Cited

U.S. PATENT DOCUMENTS

2015/0023711 A1* 1/2015 Kawanago ..... G03G 15/6567 399/394
2015/0023712 A1* 1/2015 Kawabata ..... B65H 9/002 399/394
2019/0018351 A1* 1/2019 Hirose ..... G03G 15/6529

FOREIGN PATENT DOCUMENTS

JP 11002934 A * 1/1999
JP 2002-220107 A 8/2002
JP 2010002653 A * 1/2010 ..... G03G 15/6567
JP 2012145876 A * 8/2012
JP 2016-90830 A 5/2016

* cited by examiner

*Primary Examiner* — Robert B Beatty
(74) *Attorney, Agent, or Firm* — Stein IP, LLC

(57) ABSTRACT

An image forming apparatus includes an image forming portion, a fixing unit, a position adjustment mechanism, a number-of-printed-sheets counter, and a control unit. The image forming portion includes an image carrier, a charging unit, an exposure unit, a developing unit, and a transfer member. The fixing unit has a heated rotary member and a pressing member and heats and presses the sheet passing through a fixing nip portion. A position adjustment mechanism adjusts the width-direction position of the sheet parallel to the scanning direction of optical scanning by the exposure unit. Every time the number of printed sheets reaches a predetermined number, the control unit makes the correction unit shift the width-direction position of the sheet by a predetermined amount and changes the start position of scanning by the exposure unit on the image carrier according to the direction and amount of shift.

5 Claims, 7 Drawing Sheets

IMAGE FORMING APPARATUS PROVIDED WITH A FIXING BELT AND SHEET WIDTH POSITION ADJUSTMENT MECHANISM

INCORPORATION BY REFERENCE

This application is based upon and claims the benefit of priority from the corresponding Japanese Patent Application No. 2018-233129 filed on Dec. 13, 2018, the entire contents of which are incorporated herein by reference.

BACKGROUND

The present disclosure relates to image forming apparatuses provided with a fixing unit for fixing a toner image transferred to a recording medium, such as facsimile machines, copiers, and printers. More particularly, the present disclosure relates to a method for preventing degradation of a fixing member comprising a heated rotary member, such as a fixing roller or a fixing belt, and a pressing member which is in contact with the heated rotary member to form a fixing nip portion.

In image forming apparatuses using an electrophotographic system, an image carrier such as a photosensitive drum which is electrostatically charged uniformly by a charging unit is irradiated with a laser beam from an exposure device to form a predetermined electrostatic latent image in which electrostatic charge is partly attenuated. Then, a developing unit attaches toner to the electrostatic latent image to form a toner image. The toner image is then transferred to a sheet (recording medium) by a transferring means, and unfixed toner is heated and pressed by the fixing unit to make a permanent image. In this way, an image forming process is performed.

A fixing unit is a device which melts toner while conveying a sheet using a fixing member comprising a heating member (heated rotary member) such as a fixing roller or a fixing belt and a pressing member such as a pressing roller to fix the toner to the sheet. The state of wear of the surface of the fixing member changes depending on the drive time and the number of sheets passed. Continuing to use the heating member beyond its lifetime causes an image failure or a fixing failure.

As a solution, different methods for preventing the degradation of the fixing member are proposed. For example, a belt driving device, a belt fixing unit, and an image forming apparatus are known which include: a roller around which a belt is wound and which includes a displaceable roller of which end parts are displaceable; a deviation detection member which is displaced in accordance with the deviation amount of the belt; a displacing means which displaces, in accordance with the amount of displacement of the deviation detection member, the end parts of the displaceable roller in a twisting direction in which the displaceable roller and another roller lie on different planes, and a biasing means which biases the displaceable roller and the other roller in such a direction as to move away from each other in accordance with the amount of displacement of the end parts of the displaceable roller in the twisting direction. This belt driving device is aimed at preventing degradation of the belt due to buckling and wearing of the belt resulting from contact and sliding friction with the detection member.

Furthermore, some known image forming apparatuses include a temperature sensing means for sensing the temperature of the fixing unit, a measuring means for measuring the time of passage of recording materials through the fixing unit for each size, and a control means for judging the life of the fixing member based on the temperature sensed by the temperature sensing means and time measured by the measuring means.

SUMMARY

According to one aspect of the present disclosure, an image forming apparatus includes an image forming portion, a fixing unit, a position adjustment mechanism, a number-of-printed-sheets counter, and a control unit. The image forming portion includes the image carrier on the surface of which a photosensitive layer is formed, a charging unit which electrostatically charges the image carrier, an exposure unit which optically scans the surface of the image carrier electrostatically charged by the charging unit to form an electrostatic latent image, a developing unit which develops the electrostatic latent image formed by the exposure unit into a toner image, and a transfer member which transfers the toner image developed by the developing unit from the surface of the image carrier onto a sheet. The fixing unit fixes the toner image onto the sheet by heating and pressing the sheet passing through a fixing nip portion. The fixing unit includes a heated rotary member which is arranged downstream of the image forming portion in the sheet conveying direction and which is heated by a heating device, and a pressing member which makes contact with the heated rotary member to form the fixing nip portion. The position adjustment mechanism includes a correction unit which shifts the sheet in the width direction and adjusts a width-direction position of the sheet parallel to the scanning direction the optical scanning by the exposure unit. The number-of-printed-sheets counter counts the number of printed sheets. The control unit controls the image forming portion, the fixing unit, and the position adjustment mechanism. Every time the number of printed sheets count by the number-of-printed-sheets counter reaches the predetermined number of sheets, the control unit makes the position adjustment mechanism shift the sheet either one side and the other in the width-direction by a predetermined amount and changes the start position of scanning by the exposure unit with respect to the image carrier in accordance with the direction and amount of shift of the sheet.

This and other objects of the present disclosure, and the specific benefits obtained according to the present disclosure, will become apparent from the description of embodiments which follows.

DETAILED DESCRIPTION

Figure 1:
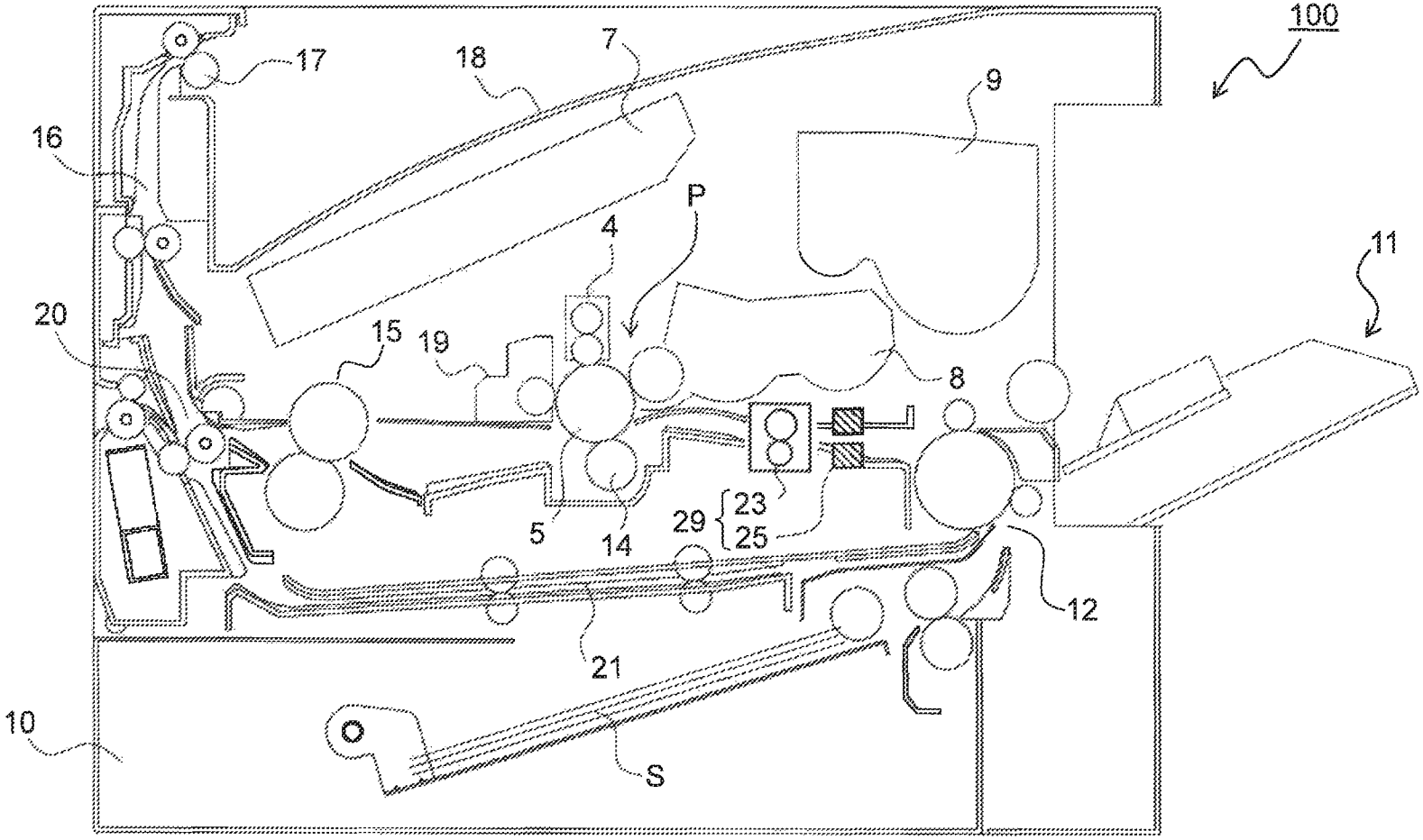
FIG. 1 is a side sectional view showing an internal structure of an image forming apparatus according to one embodiment of the present disclosure.

Hereinafter, with reference to the accompanying drawings, embodiments of the present disclosure will be described. FIG. 1 is a side sectional view showing the internal structure of an image forming apparatus 100 according to one embodiment of the present disclosure. Inside the image forming apparatus (for example, a monochrome printer) 100, there is arranged an image forming portion P that forms a monochrome image through processes of charging, exposure, development, and transfer. In the image forming portion P, there are arranged, along the rotating direction of a photosensitive drum 5 (in the clockwise direction in FIG. 1), a charging unit 4, an exposure unit (for example, a laser scanning unit) 7, a developing unit 8, a transfer roller 14, a cleaning device 19, and a static eliminator (unillustrated).

When image forming operation is performed, the charging unit 4 electrostatically charges the photosensitive drum 5 uniformly which rotates in the clockwise direction. The exposure unit 7 irradiates the photosensitive drum 5 with a laser beam based on image data, and thereby forms an electrostatic latent image on the photosensitive drum 5. Then, developer (hereinafter called toner) is attached to the electrostatic latent image by a developing unit 8 to form a toner image.

Toner is fed to the developing unit 8 from a toner container 9. Image data is transmitted from a personal computer (unillustrated) or the like. A static eliminator (unillustrated) that removes residual electric charges on the surface of the photosensitive drum 5 is provided on the downstream side of a cleaning device 19 in the rotating direction of the photosensitive drum 5.

Toward the photosensitive drum 5, where a toner image has now been formed as described above, a sheet S is conveyed from a sheet feeding cassette 10 (or a manual sheet feeding device 11), and the toner image formed on the surface of the photosensitive drum 5 is transferred to the sheet S by a transfer roller 14. The sheet S having the toner image transferred to it is separated from the photosensitive drum 5, and is conveyed to a fixing unit 15, where the toner image is fixed. The sheet S having passed through the fixing unit 15 is conveyed to an upper part of the image forming apparatus 100 through a sheet conveying passage 16, and when an image is formed on only one side of the sheet S (during one-sided printing), the sheet S is discharged to a discharge tray 18 by a discharge roller pair 17.

On the other hand, when images are formed on both sides of a sheet S (during double-sided printing), after the trailing edge of the sheet S passes a branch portion 20 of the sheet conveying passage 16, the conveying direction is reversed. With this, the sheet S is directed to a reversing conveying passage 21 that branches from the branch portion 20, and is conveyed again to the image forming portion P with the image face reversed. Then, the next toner image formed on the photosensitive drum 5 is transferred to the face of the sheet S on which no image has yet been formed by the transfer roller 14. The sheet S having the toner image transferred to it is conveyed to the fixing unit 15 to have the toner image fixed to it, and is then discharged to the discharge tray 18 by the discharge roller pair 17.

On the upstream side of the image forming portion P in the sheet conveying direction, a correction unit 23 is arranged. The correction unit 23, while correcting a skew and a positional deviation in the width direction of the sheet S, sends out the sheet S toward the image forming portion P with predetermined timing.

An edge detection sensor 25 is arranged upstream of and close to the correction unit 23. The edge detection sensor 25 senses the position (edge position) of an end of the sheet S in the width direction (the direction perpendicular to the sheet conveying direction). The correction unit 23 and the edge detection sensor 25 constitute a position adjustment mechanism 29 for adjusting the position of the sheet S in the width direction parallel to the direction of the optical scanning by the exposure unit 7. The structure of the correction unit 23 and the edge detection sensor 25 will be described in detail later.

Figure 2:
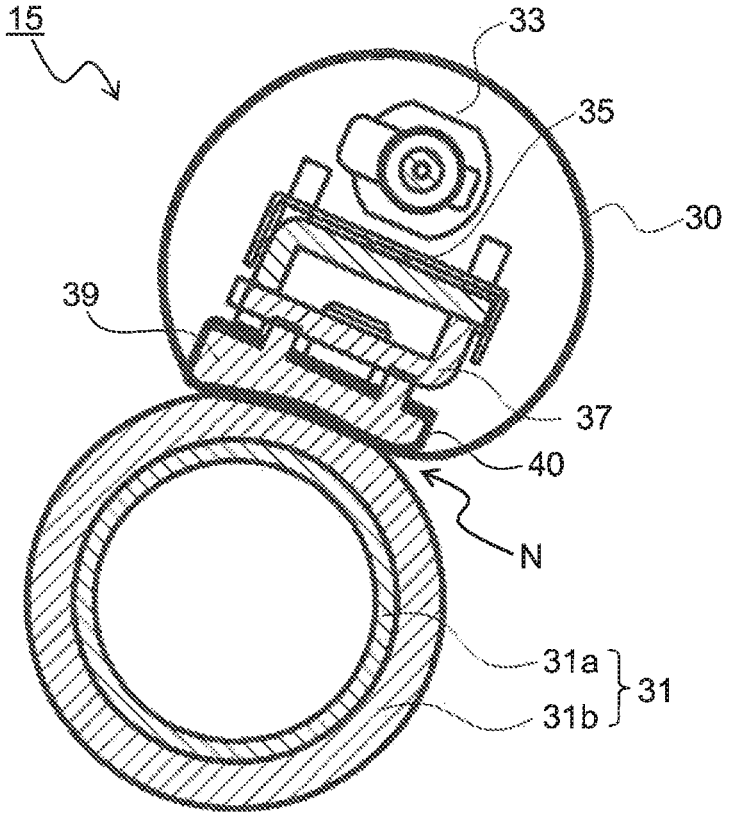
FIG. 2 is a side sectional view of a fixing unit incorporated in the image forming apparatus of the embodiment.

FIG. 2 is a side sectional view of the fixing unit 15 incorporated in the image forming apparatus 100. The fixing unit 15 is a belt fixing system provided with a fixing belt (heated rotary member) 30, a pressing roller (pressing member) 31, a heater (heating device) 33, a reflection plate 35, a supporting stay 37, a nip plate 39, and a sliding sheet 40. In FIG. 2, the housing of the fixing unit 15 is omitted from illustration.

The fixing belt 30 is an endless belt composed of a plurality of stacked layers including a base layer provided on the innermost side (heater 33 side) and a release layer provided on the outermost side (pressing roller 31 side). To the fixing belt 30, a predetermined tension is applied by the nip plate 39 and an end cap (unillustrated).

A thermistor (unillustrated) is provided so as to face the outer circumferential face of the fixing belt 30. The thermistor senses the temperature at the surface of the fixing belt 30 and controls the fixing temperature by turning on and off the heater 33.

The dimension of the fixing belt 30 in the width direction (the direction perpendicular to the plane of FIG. 2) is set to be larger than the maximum width of the sheet that passes through the fixing nip portion N. In this way, the fixing belt 30 can cover the entire surface of the sheet S regardless of the sheet size, and thus it is possible to prevent unfixed toner from attaching to the pressing roller 31 and the nip plate 39.

Used as the pressing roller 31 is a member in which an elastic layer 31*b* of silicone rubber or the like is laid around the outer circumferential face of a cylindrical metal base 31*a* composed of a material such as a metal. The surface of the elastic layer 31*b* is coated with a release layer (unillustrated) such as a fluororesin coat.

The heater 33 is an infrared lamp (halogen lamp) using a filler gas which is an inert gas with a tiny amount of a halogen substance added to it, and heats the fixing belt 30 by generating radiant heat. The reflection plate 35 reflects the radiant heat from the heater 33 and heats the fixing belt 30 efficiently.

A supporting stay 37 is formed in rectangular columnar shape by combining and welding together two metal plates with an L-shaped cross section. On the top face of the supporting stay 37, the reflection plate 35 is supported, and on the bottom face of the supporting stay 37, the nip plate 39, which will be described later, is supported. Both ends of the supporting stay 37 are fixed to housing side plates (unillustrated) of the fixing unit 15.

The nip plate 39 makes contact with the pressing roller 31 via the fixing belt 30 to form a fixing nip portion N through which the sheet S is passed. The nip plate 39 is formed of a heat-resistant resin such as a liquid crystal polymer or an elastic material such as a silicone rubber, and on its face facing the fixing belt 30, an elastomer may be arranged.

The sliding sheet 40 is wound around the outside of the nip plate 39 for reducing the sliding load on the contact face (sliding face) between the fixing belt 30 and the nip plate 39. For the sliding sheet 40, a fluororesin sheet such as a PTFE sheet is used.

The pressing roller 31 is kept in pressed contact with the fixing belt 30 with a predetermined pressure. When the pressing roller 31 rotates counter-clockwise in FIG. 2 by the action of a motor (unillustrated), the friction force between the pressing roller 31 and the outer circumferential face of the fixing belt 30 makes the nip plate 39 (sliding sheet 40) slide on the inner circumferential face of the fixing belt 30, and the fixing belt 30 is thus driven to rotate clockwise in FIG. 2. At a part where the fixing belt 30 and the pressing roller 31 make contact with each other while rotating in the opposite directions, a fixing nip portion N is formed.

The sheet S is conveyed from an upstream side (the right side in FIG. 2) in the sheet conveying direction to the fixing nip portion N, and the sheet S is heated and pressed there by the fixing belt 30 and the pressing roller 31. Toner in a powdery state on the sheet S is thereby thermally fused to be fixed on the sheet S. The sheet S after fixing processing is separated from the surface of the fixing belt 30 by an unillustrated separation claw, and then is conveyed toward the downstream side (the left side in FIG. 2) of the fixing unit 15 in the sheet conveying direction.

Figure 3:
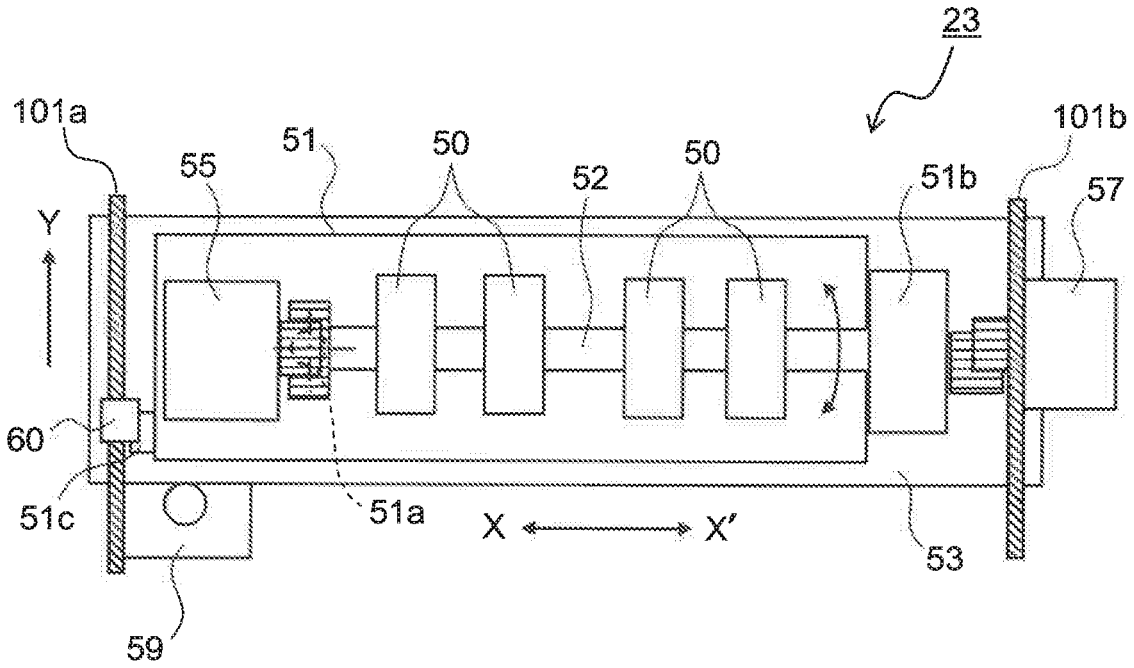
FIG. 3 is a plan view of a correction unit incorporated in the image forming apparatus of the embodiment as seen from above.
Figure 4:
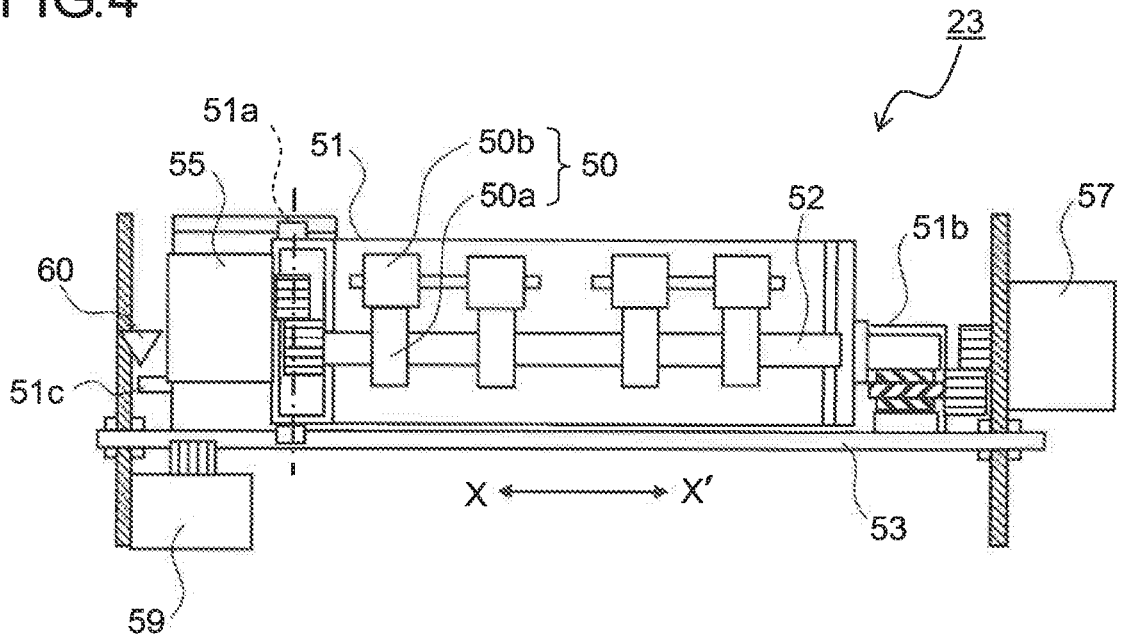
FIG. 4 is a side view of the correction unit as seen from the upstream side (the bottom side in FIG. 3) in the sheet conveying direction.

Next, the structure of the correction unit 23 will be described in detail. FIG. 3 is a plan view of the correction unit 23 as seen from above, and FIG. 4 is a side view of the correction unit 23 as seen from the upstream side (the bottom side in FIG. 3) in the sheet conveying direction. The correction unit 23 includes a correction roller pair 50, a roller holder 51, a carriage 53, a roller driving motor 55, a skew correction motor 57, and a shift correction motor 59.

A plurality of (here, four) correction roller pairs 50 are arranged in the sheet width direction. Each correction roller pair 50 is composed of a driving roller 50*a* and a driven roller 50*b*. The roller holder 51 rotatably supports a rotary shaft 52 of the driving roller 50*a*. At one end side (the left side in FIGS. 3 and 4) of the roller holder 51 in the sheet width direction, a swing pivot 51*a* is provided, and the other end side (the right side in FIGS. 3 and 4) is swingable about the swing pivot 51*a* with respect to the carriage 53 in the sheet conveying direction. The carriage 53 is supported so as to be movable in the sheet width direction with respect to the frames 101*a* and 101*b* at the front side and the rear side of the image forming apparatus 100.

The roller driving motor 55 is coupled to the rotary shaft 52 via a plurality of gears and rotates and stops the rotary shaft 52. The skew correction motor 57 is coupled to a rack 51*b* provided at the swinging end of the roller holder 51 via a plurality of gears and changes the inclination of the roller holder 51 with respect to the sheet conveying direction. A shift correction motor 59 is coupled to rack teeth (unillustrated) formed at the edge of the carriage 53 and makes the carriage 53 reciprocate in the sheet width direction. For the roller driving motor 55, the skew correction motor 57, and the shift correction motor 59, stepping motors are used which can accurately control the rotation direction and the rotation amount (rotation angle) through pulse control.

On the frame 101*a*, a holder position sensor 60 for sensing the reference position (home position) of the roller holder 51 is arranged. The holder position sensor 60 is a PI (photointerruptor) sensor having a sensing area (unillustrated) with a light emitting portion and a light receiving portion. In an end part of the roller holder 51 on the frame 101*a* side, a light-shielding plate 51*c* is provided, and the position at which the light-shielding plate 51*c* shields the sensing area of the holder position sensor 60 from light is sensed as the reference position of the roller holder 51. Here, the reference position is the position where the roller holder 51 is at the middle in the sheet width direction and its inclination with respect to the sheet conveying direction is zero (that is, perpendicular to the conveying direction).

Figure 5:
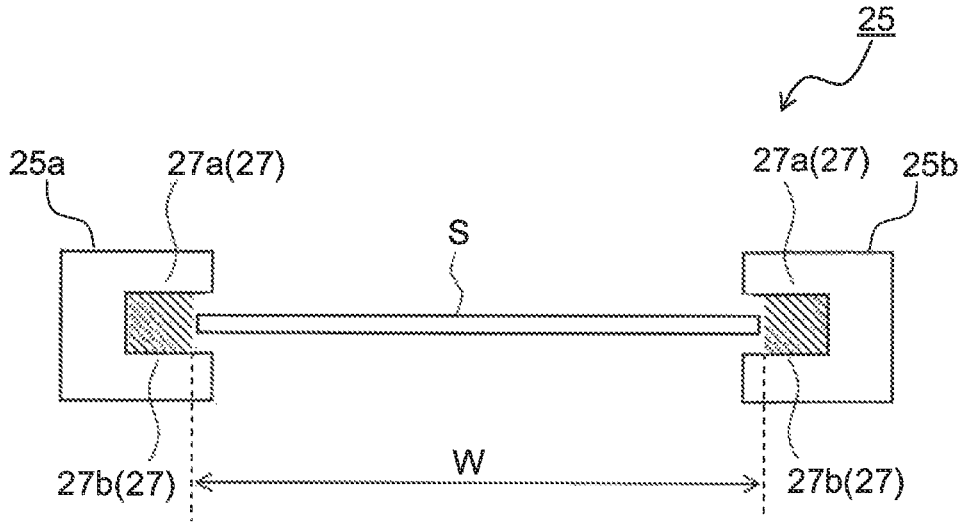
FIG. 5 is a front view of an edge detection sensor incorporated in the image forming apparatus of the embodiment as seen from the upstream side in the sheet conveying direction, illustrating a state in which the conveyance position of a sheet is set at a reference position.
Figure 6:
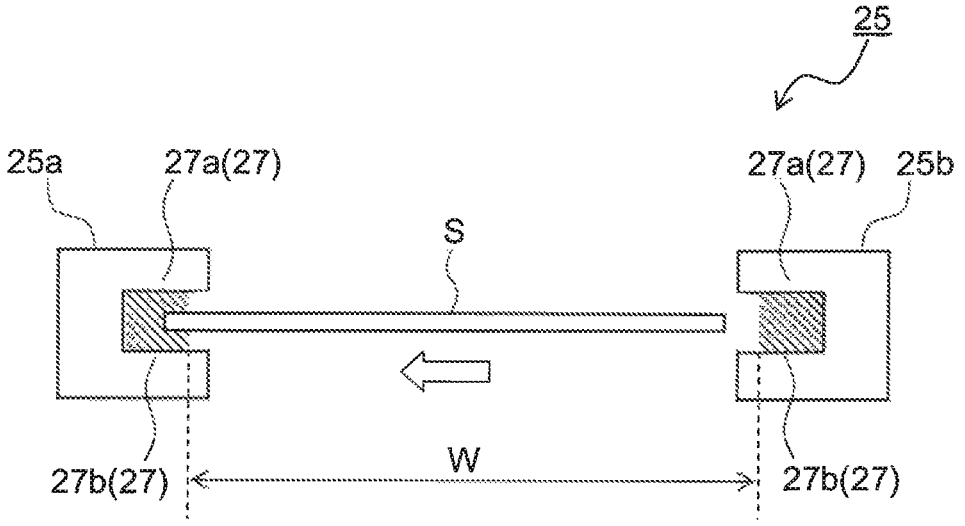
FIG. 6 is a front view of the edge detection sensor as seen from the upstream side in the sheet conveying direction, illustrating a state in which the conveyance position of the sheet is shifted toward one side in the width direction.

Next, the structure of the edge detection sensor 25 will be described in detail. FIGS. 5 and 6 are front views of the edge detection sensor 25 as seen from the upstream side in the sheet conveying direction. The edge detection sensor 25 has a first sensing portion 25*a* for sensing the edge position of one side of the sheet S in the width direction (the left side in FIGS. 5 and 6) and a second sensing portion 25*b* for sensing the edge position of the other side (the right side in FIGS. 5 and 6).

The first and second sensing portions 25*a* and 25*b* are each a PI (photointerruptor) sensor including a sensing area 27 (the area indicated by hatching in FIGS. 5 and 6) provided with a light emitting portion 27*a* and a light receiving portion 27*b*. The first and second sensing portions 25*a* and 25*b* are arranged at opposite ends in the width direction so that the respective sensing areas 27 face each other. The interval between the sensing areas 27 is substantially the same as the dimension of the sheet S in the width direction to be conveyed (297 mm in the case of A4 landscape).

Figure 9:
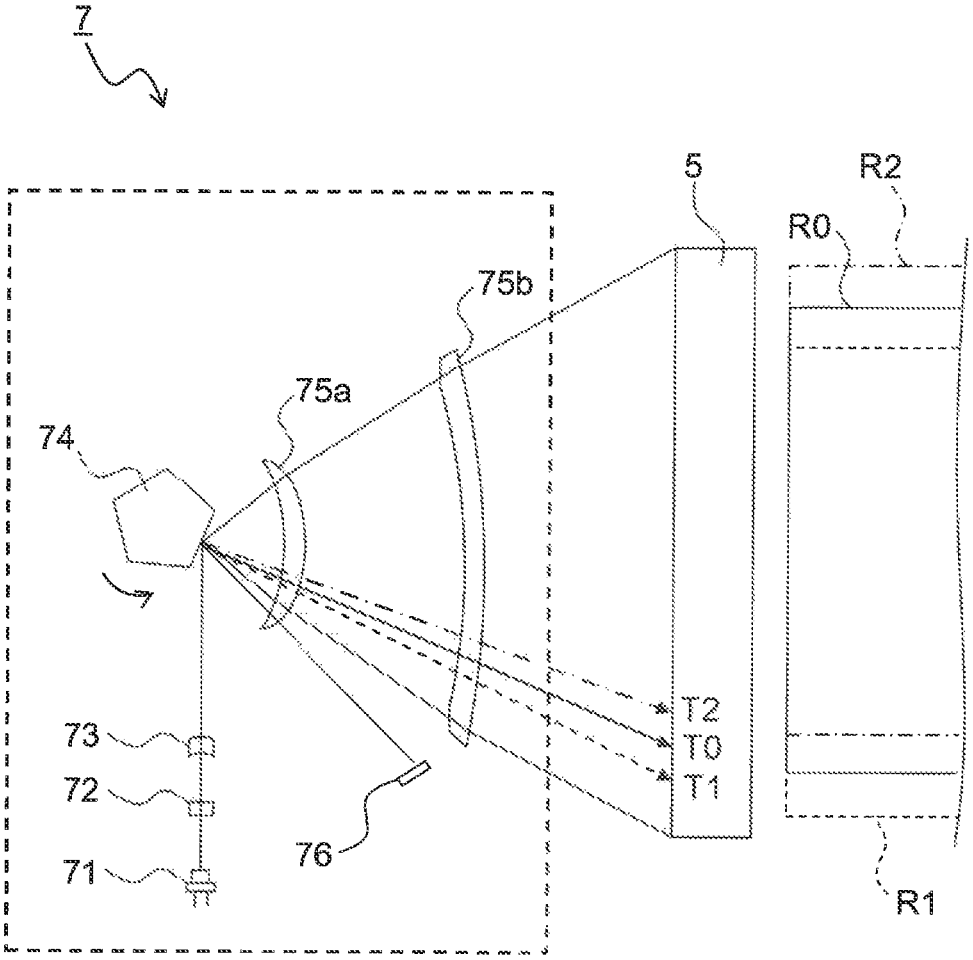
FIG. 9 is a plan view schematically showing a relationship between the width-direction position of the sheet and the writing start position of an exposure unit with respect to a photosensitive drum.

FIG. 5 shows a state where the conveyance position of the sheet S is set at a reference position R0 (see FIG. 9). Here, neither of the ends of the sheet S in the width direction overlaps the sensing area 27 of the first and second sensing portions 25*a* and 25*b*, and the light reception signal levels of the first and second sensing portions 25*a* and 25*b* are both in HIGH state.

FIG. 6 shows a state where the conveyance position of the sheet S has shifted to one side (the left side in FIGS. 5 and 6) in the width direction. When the sheet S shifts to one side (the left side) in the width direction from the state in FIG. 5, as shown in FIG. 6, the edge of the sheet S overlaps the sensing area 27 of the first sensing portion 25*a* and the light reception signal level of the first sensing portion 25*a* turns to LOW state. Likewise, when the sheet S shifts toward the other side (the right side), the light reception signal level of the second sensing portion 25*b* turns to LOW state. In this way, the shift of the sheet S toward the one side (the left side) and the other side (the right side) is sensed.

Figure 7:
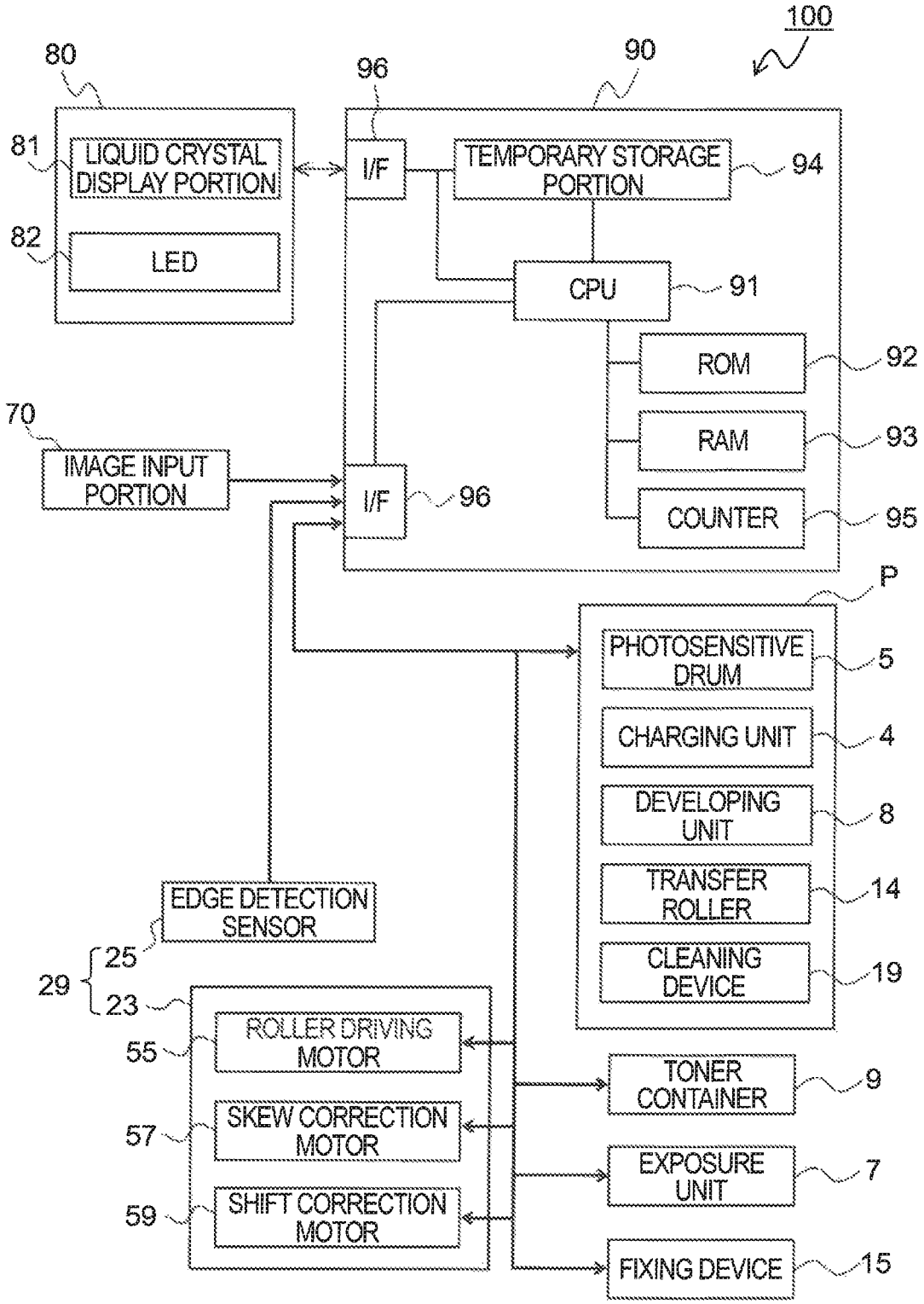
FIG. 7 is a block diagram showing control paths in the image forming apparatus of the embodiment.

The output signal from the edge detection sensor 25 is transmitted to a control unit 90 (see FIG. 7). The control unit 90, based on the detection result, transmits a control signal to the shift correction motor 59 in the correction unit 23 to correct the lateral deviation of the sheet S. A skew in the sheet S is sensed by another sensor (unillustrated) such as a CIS, and the control unit 90, based on the detection result, transmits the a control signal to the skew correction motor 57 to correct the skew in the sheet S.

FIG. 7 is a block diagram showing one example of control paths in the image forming apparatus 100 of this embodiment. When the image forming apparatus 100 is used, different parts of the device are controlled in different manners, and thus the control paths in the whole image forming apparatus 100 are complicated. Thus, the following description focuses on those control paths which are essential for the implementation of the present disclosure.

An image input portion 70 is a reception portion for receiving image data transmitted to the image forming apparatus 100 from a PC or the like. The image signal input via the image input portion 70 is converted to a digital signal and is then transmitted to a temporary storage portion 94.

An operating portion 80 has a liquid crystal display portion 81 and LEDs 82 that indicates different statuses, and is configured to display the status of the image forming apparatus 100, the status of image formation, the number of copies printed, and so on. Various settings for the image forming apparatus 100 are made via a printer driver on a PC.

The control unit 90 is provided at least with a CPU (central processing unit) 91, a ROM (read-only memory) 92 which is a read-only storage portion, a RAM (random access memory) 93 which is a readable-writable storage portion, the temporary storage portion 94 which temporarily stores image data and the like, a counter 95, a plurality of (here, two) I/Fs (interfaces) 96 which transmits control signals to different devices in the image forming apparatus 100 and receives input signals from the operation portion 80.

The ROM 92 stores data and the like that are not changed during the use of the image forming apparatus 100, such as control programs for the image forming apparatus 100 and numerical values needed for control. The RAM 93 stores necessary data generated during the control of the image forming apparatus 100, data temporarily needed to control the image forming apparatus 100, and the like. The RAM 93 (or ROM 92) also stores the timing of position change (number of printed sheets N) and the direction and amount of shift to be used in width-direction position change control for the sheet S in the width direction, which will be described later.

The temporary storage portion 94 temporarily stores an image signal that is input, after being converted to a digital signal, from an image input portion (unillustrated) which receives image data transmitted from a PC and the like. The counter 95 counts the number of printed sheets in a cumulative manner.

The control unit 90 transmits control signals to different parts and devices in the image forming apparatus 100 from the CPU 91 through the I/F 96. From the different parts and devices, signals that indicate their statuses and input signals are transmitted through the I/F 96 to the CPU 91. The different parts and devices controlled by the control unit 90 include, for example, the image forming portion P, the fixing unit 15, the correction unit 23, the edge detection sensor 25, the image input portion 70, and the operation portion 80.

As described previously, when the sheet S repeatedly passes at the same place on the fixing belt 30 in the width direction, the side edge of the sheet S causes a groove to develop in the surface of the fixing belt 30. This may lead to degradation in fixing performance where the groove has developed and, as the groove grows deeper, the fixing belt 30 may break. To avoid this, in this embodiment, the width-direction position change control is performed in which the conveyance position in the width direction (hereinafter, referred to as the width-direction position) of the sheets S is shifted every predetermined number of printed sheets.

Figure 8:
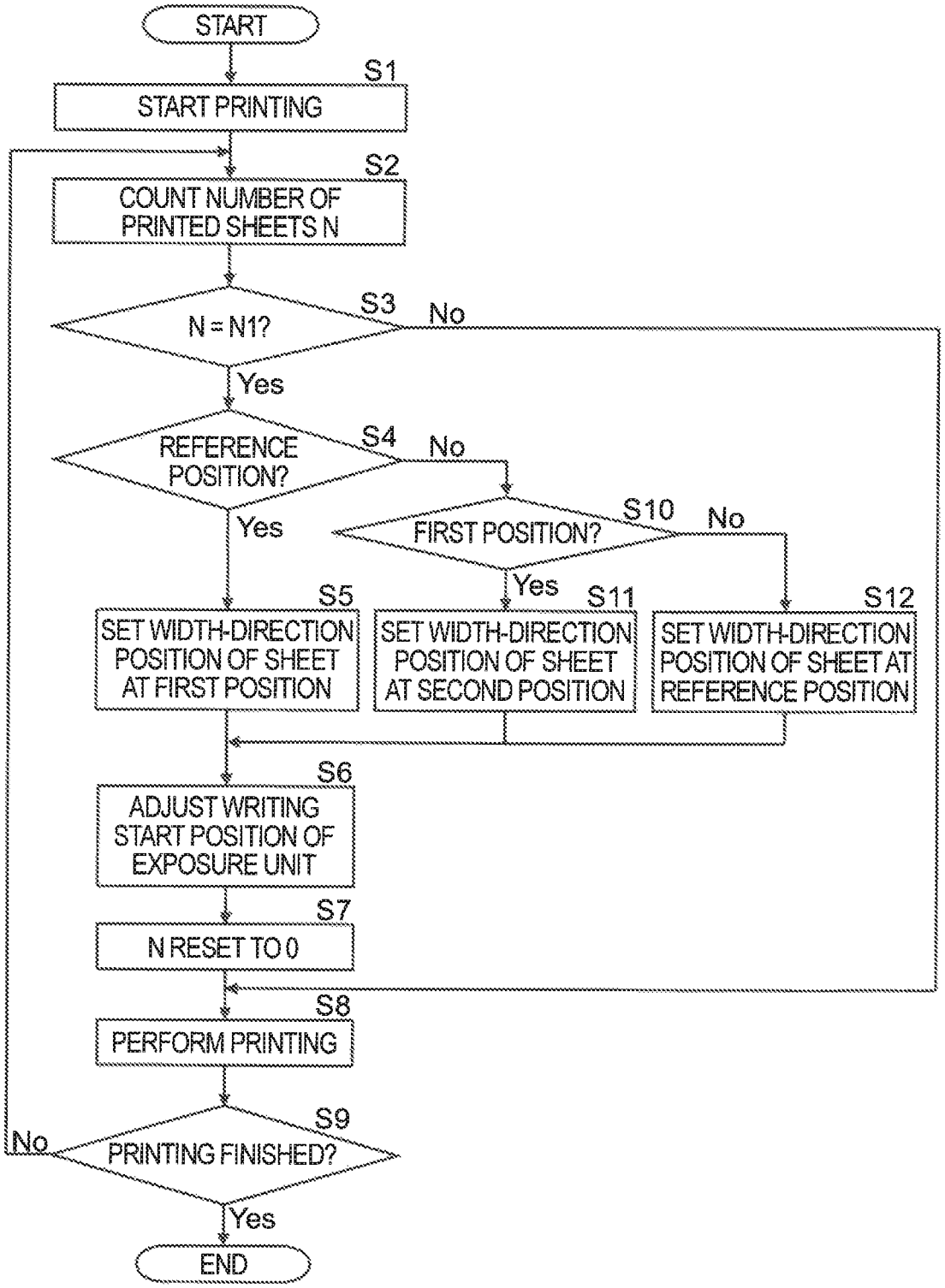
FIG. 8 is a flow chart showing width-direction position change control for the sheet in the image forming apparatus of the embodiment.

FIG. 8 is a flow chart showing the width-direction position change control for the sheet S in the image forming apparatus 100 of this embodiment. With reference to FIGS. 1 to 7 and also FIG. 9, which will be described later, as necessary, the procedure for changing the width-direction position of the sheet S will be described in detail along the steps in FIG. 8. The width-direction position of the sheet S at the start of use (in the default state) of the fixing belt 30 is set at the reference position R0 shown in FIG. 5.

When a printing instruction is input from a host device such as a PC and printing is started (step S1), the counter 95 counts the number of printed sheets N (step S2). Next, the control unit 90 judges whether the number of printed sheets N has reached the predetermined number of sheets N1 (here, 10) (step S3).

When the number of printed sheets N has reached the predetermined number of sheets N1 (Yes in step S3), whether the width-direction position of the sheet S is set at the reference position R0 is checked (step S4). At the start of printing, it is set at the reference position R0 (Yes in step S4), and thus the control unit 90 sets the width-direction position of the sheet S at a position (hereinafter, referred to as a first position R1) deviated from the reference position by a predetermined distance toward one side (the left side in FIG. 5, the first direction) in the width direction (step S5).

Specifically, the control unit 90 transmits a control signal to the shift correction motor 59 in the correction unit 23 and drives the shift correction motor 59 as many times as the number of transmitted motor pulses to move the correction roller pair 50 together with the carriage 53 and the roller holder 51 from the reference position R0, and thereby shifts the width-direction position of the sheet S. Next, the writing start position of the exposure unit 7 is adjusted (step S6).

FIG. 9 is a plan view schematically showing a relationship between the width-direction position of the sheet S and the writing start position of the exposure unit 7 with respect to the photosensitive drum 5. The exposure unit 7 includes an LD unit 71, a collimator lens 72, a cylindrical lens 73, a polygon mirror 74, scanning lenses 75*a* and 75*b*, and a BD sensor 76.

The LD unit 71 includes a laser diode (LD) as a light source and emits a light beam (laser beam) which is optically modulated based on an image signal. The collimator lens 72 forms the laser beam emitted from the LD unit 71 into a substantially parallel beam. The cylindrical lens 73 has a predetermined refractive power only in the sub scanning direction of the laser beam. The parallel beam having passed through the collimator lens 72 and entered the cylindrical lens 73 emerges still as a parallel beam in the main scanning direction cross section but in a form converged in the sub scanning direction cross section, to form a linear image on the deflective face (reflective face) of the polygon mirror 74.

The polygon mirror 74 comprises a rotary polygonal mirror in the shape of a regular polygon (here, a regular pentagon) having a plurality of deflective faces (reflective face) as its side faces, and it rotates in the counter-clockwise direction in FIG. 9 at a predetermined speed by the action of a driving mean (unillustrated) such as a motor. The scanning lenses 75*a* and 75*b* are lenses with fθ characteristics, and the laser beam deflected/reflected by the polygon mirror 74 passes through the scanning lenses 75*a* and 75*b* to form an image with a predetermined spot diameter on the photosensitive drum 5, thereby achieving scanning in the main scanning direction (bottom-to-top direction in FIG. 9).

The BD sensor 76 is arranged outside the effective exposure region on the scanning start side. The BD sensor 76 outputs a signal to the control unit 90 (see FIG. 7) according to the timing with which a laser beam is detected. For the BD sensor 76, any of various kinds of optical sensors such as a photo diode, a photo transistor, and a photo IC can be used.

When the width-direction position of the sheet S is set at the reference position R0, the writing start position of the exposure unit 7 with respect to the photosensitive drum 5 is set at T0. When the width-direction position of the sheet S is set at the first position R1, the width-direction position of the sheet S shifts toward the scanning start side (the lower side in FIG. 9), and thus the transfer position of a toner image on the sheet S shifts toward the scanning end side (the upper side in FIG. 9).

Thus, when the width-direction position of the sheets S is set at the first position R1, the writing start position (scanning start position) is set at T1 by advancing the light emission timing of the LD unit 71 in accordance with the amount of shift of the width-direction position from the reference position R0 to the first position R1 and thereby advancing the timing of detection of a laser beam by the BD sensor 76. That is, the scanning start position is shifted in the first direction.

As shown back in FIG. 8, the control unit 90 resets the number of printed sheets N counted by the counter 95 (step S7) and performs printing with the width-direction position of the sheet S set at the first position R1 and the writing start position set at T1 (step S8). In this way, a toner image can be transferred to the middle, in the width direction, of the sheet S conveyed at the first position R1.

On the other hand, when, in step S4, the width-direction position of the sheet S is not set at the reference position R0 (No in step S4), the control unit 90 checks whether the width-direction position of the sheet S is set at the first position R1 (step S10). When, in the previous step S5, the width-direction position of the sheet S is set at the first position R1 (Yes in step S10), the control unit 90 sets the width-direction position of the sheet S at a position (hereinafter, referred to as a second position R2) deviated from the reference position R0 by a predetermined distance toward the other side (the right side in FIG. 5, the second direction) in the width direction (step S11).

Specifically, the control unit 90 transmits a control signal to the shift correction motor 59 in the correction unit 23 and drives the shift correction motor 59 as many times as the number of transmitted motor pulses to move the correction roller pair 50 together with the carriage 53 and the roller holder 51 from the first position R1, and thereby shifts the width-direction position of the sheet S.

Next, the writing start position of the exposure unit 7 is adjusted (step S6). When the conveyance position of the sheet S is set at the second position R2, the width-direction position of the sheet S shifts toward the scanning end side (the upper side in FIG. 9), and thus the transfer position of a toner image on the sheet S shifts toward the scanning start side (the lower side in FIG. 9).

Thus, when the width-direction position of the sheets S is set at the second position R2, the writing start position (scanning start position) is set at T2 by delaying the light emission timing of the LD unit 71 in accordance with the amount of shift of the width-direction position from the first position R1 to the second position R2 and thereby delaying the timing of detection of a laser beam by the BD sensor 76. That is, the scanning start position is shifted in the second direction.

When, in step S10, the width-direction position of the sheet S is not set at the first position R1 (No in step S10), it means that it is set at the second position R2 in the previous step S11, and thus the control unit 90 sets the conveyance position of the sheet S at the reference position R0 (step S12).

Next, the writing start position of the exposure unit 7 is adjusted (step S6). When the width-direction position of the sheet S is set at the reference position R0, the width-direction position of the sheet S shifts to the scanning start side (the lower side in FIG. 9), and thus the transfer position of a toner image on the sheet S shifts toward the scanning end side (the upper side in FIG. 9). The writing start position (scanning start position) is set at T0 by advancing the light emission timing of the LD unit 71 in accordance with the amount of shift of the width-direction position from the second position R2 to the reference position R0 and thereby advancing the timing of detection of a laser beam by the BD sensor 76.

The control unit 90 resets the number of printed sheets N counted by the counter 95 (step S7) and performs printing (step S8). When, in step S3, the number of printed sheets N has not reached the predetermined number of sheets N1 (No in step S3), printing is performed with no shift of the width-direction position of the sheet S and no adjustment of the writing start position (step S8).

Then, whether printing is finished is checked (step S9), and when printing continues (No in step S9), the procedure returns to step S2 and similar processing is performed. When printing is finished (Yes in step S9), the procedure is finished.

With the control described above, the width-direction position of the sheet S is changed every time the number of printed sheets reaches the predetermined number of sheets N1 (here, 10), and thus it is possible to prevent the sheet S from repeatedly passing at the same place on the fixing belt 30. Thus, it is possible to prevent a groove from developing in the surface of the fixing belt 30 due to repeated passage of the edge of the sheet S, and thus it is possible to prevent degradation in fixing performance and breakage of the fixing belt 30. Local wear of the surface of the fixing belt 30 can also be suppressed, and thus the replacement period of the fixing belt 30 can be extended. This also helps reduce maintenance costs.

Adjusting the writing start position of the exposure unit 7 in accordance with the width-direction position of the sheet S allows a toner image to be transferred to the middle, in the width direction, of the conveyed sheet S regardless of whether the width-direction position of the sheet S is the reference position R0, the first position R1, or the second position R2.

Furthermore, changing the width-direction position of the sheet S using the correction unit 23 helps reduce collision noise and damage to the side edge of the sheet S compared with a configuration in which a skew and the width-direction position of the sheet S are corrected by keeping the side edge of the sheet S in contact with a side guide member.

Although the width-direction position of the sheet S is changed sequentially among three positions, namely the reference position R0, the first position R1, and the second position R2, the width-direction position may be changed among four or more positions. The number of printed sheets N1 as a threshold value for changing the width-direction position is not limited to 10; it may instead be any number of sheets.

The embodiment described above is in no way meant to limit the present disclosure, which thus allows for many modifications and variations within the spirit of the present disclosure. For example, although the above embodiments deal with an image forming apparatus 100 provided with a fixing unit 15 of a belt-fixing type using a fixing belt 30, applying the present disclosure to an image forming apparatus provided with a fixing unit of a roller-fixing type having a fixing roller instead of the fixing belt 30 allows to prevent local wear of the surface layer (release layer) of the fixing roller, and thereby to suppress degradation in fixing performance and extend the lifetime of the fixing roller.

Although the above embodiments deal with an example where two PI sensors (the first and second sensing portions 25*a* and 25*b*) are arranged at opposite ends in the width direction as an edge detection sensor 25, any other sensors such as CISs may also be used.

Although the above embodiments deal with a monochrome printer as an example of an image forming apparatus 100, the present disclosure may be applied, not only to monochrome printers, but also to image forming apparatuses of an electrophotographic type such as color printers, monochrome and color copiers, digital multifunction peripherals, and facsimile machines which transfer a toner image onto a sheet (recording medium) and fix the transferred unfixed toner with a fixing unit.

What is claimed is:

1. An image forming apparatus comprising:

an image forming portion including an image carrier on a surface of which a photosensitive laver is formed, a charging unit which electrostatically charges the image carrier, an exposure unit which optically scans the surface of the image carrier electrostatically charged by the charging unit to form an electrostatic latent image, a developing unit which develops the electrostatic latent image formed by the exposure unit into a toner image, and a transfer member which transfers the toner image developed by the developing unit from the surface of the image carrier onto a sheet;

a fixing unit which is arranged downstream of the image forming portion in a sheet conveying direction and fixes the toner image onto the sheet by heating and pressing the sheet passing through a fixing nip portion, the fixing unit includes a heated rotary member which is heated by a heating device, and a pressing member which makes contact with the heated rotary member to form the fixing nip portion, a position adjustment mechanism which adjusts a width-direction position of the sheet parallel to a scanning direction of optical scanning by the exposure unit;

a number-of-printed-sheets counter which counts the number of printed sheets; and a control unit which controls the image forming portion, the fixing unit, and the position adjustment mechanism, wherein the position adjustment mechanism includes a correction unit which shifts the sheet in the width direction, and the control unit makes the correction unit shift the sheet to either one side or the other in the width-direction by a predetermined amount every time the number of printed sheets reaches a predetermined number of sheets, and changes a start position of scanning by the exposure unit in accordance with a direction and an amount of shift of the sheet, the heated rotary member comprises an endless fixing belt which rotates at a speed substantially equal to a conveyance speed of the sheet and is set to be replaced at every lapse of a predetermined replacement period, and the control unit sets the width-direction position of the sheet at the start of use of the fixing belt as a reference position, and makes the position adjustment mechanism change the width-direction position of the sheet among the reference position, a first position which is a predetermined distance away from the reference position toward one side in the width direction, and a second position which is a predetermined distance away from the reference position toward another side in the width direction in an order of a direction from the reference position to the first position, a direction from the first position to the second position, and a direction from the second position to the reference position.

2. The image forming apparatus according to claim 1, wherein every time the number of printed sheets passing through the heated rotary member has reached the predetermined number of sheets, the control unit changes the width-direction position of the sheet and the scanning start position in accordance with the change of the width-direction position of the sheet.

3. The image forming apparatus according to claim 2, wherein the control unit changes the width-direction position of the sheet among a plurality of predetermined positions sequentially.

4. The image forming apparatus according to claim 1, wherein the first position and the second position are the positions away from the reference position by the predetermined distances in a first direction which is the direction of optical scanning and in a second direction which is an opposite direction to the first direction respectively, when the width-direction position of the sheet is shifted from the reference position to the first position, the scanning start position is shifted in the first direction in accordance with an amount of shift from the reference position to the first position, when the width-direction position of the sheet is shifted from the first position to the second position, the scanning start position is shifted in the second direction in accordance with an amount of shift from the first position to the second position, and when the width-direction position of the sheet is shifted from the second position to the first position, the scanning start position is shifted in the first direction in accordance with an amount of shift from the second position to the reference position.

5. The image forming apparatus according to claim 1, wherein the correction unit includes a correction roller pair which corrects the width-direction position of the sheet while conveying the sheet, and a shift correction motor which shifts the correction roller pair in the width direction, and the shift correction motor comprises a stepping motor of which a rotation direction and a rotation amount can be controlled through pulse control.

* * * * *